United States Patent [19]

Norris

[11] Patent Number: 4,865,513

[45] Date of Patent: Sep. 12, 1989

[54] PORTABLE MANWAY COVER HANDLING APPARATUS

[76] Inventor: John J. Norris, 133 Seacord Rd., New Rochelle, N.Y. 10804

[21] Appl. No.: 198,179

[22] Filed: May 24, 1988

[51] Int. Cl.[4] ..... B66C 23/20

[52] U.S. Cl. ..... 414/684.3; 212/166; 29/426.3; 29/434; 414/569

[58] Field of Search ..... 414/10, 11, 569, 681, 414/684.3, 731; 212/166; 29/426.3, 434

[56] References Cited

U.S. PATENT DOCUMENTS

| | | | |
|---|---|---|---|
| 2,718,865 | 9/1955 | Kurzmann | 414/569 X |
| 2,869,741 | 1/1959 | Winters et al. | 414/569 |
| 3,409,158 | 11/1968 | Lull | 414/11 X |
| 4,051,682 | 10/1977 | Lockwood, Jr. | 414/11 X |
| 4,313,709 | 2/1982 | Herman | 414/684.3 |
| 4,360,310 | 11/1982 | Kost | 414/684.3 |
| 4,664,586 | 5/1987 | Vassalotti | 414/684.3 X |
| 4,749,324 | 6/1988 | Rulison | 414/10 |

FOREIGN PATENT DOCUMENTS

| | | | |
|---|---|---|---|
| 375882 | 2/1936 | France | 414/10 |

*Primary Examiner*—Robert J. Spar
*Assistant Examiner*—William M. Hierz
*Attorney, Agent, or Firm*—Brooks Haidt Haffner & Delahunty

[57] ABSTRACT

A boom is mounted within a sleeve for longitudinal translation and the sleeve is hinged to a base plate that is securable by a C-clamp to a superstructure beam in front of a manway cover. An hydraulic actuator bears against the sleeve to adjust its elevation. A powered cable winch is joined to one end of the boom and its cable passes through the boom which is hollow to the opposite end and about a pulley to a fastener for attachment to an eye secured in the upper edge of the manway cover. A presser foot is hydraulically actuated to bear against the manway cover with the cable attached to the cover so that the bolts holding the cover in place can be removed. The cable can be payed out to lower the cover to a suitable location below. Guide pins are provided for installation in the mounting flange to pilot the cover into registration with the bolt holes when the cover is to be mounted rather than demounted.

9 Claims, 5 Drawing Sheets

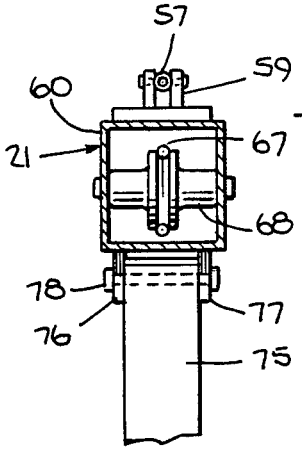
Fig. 6.
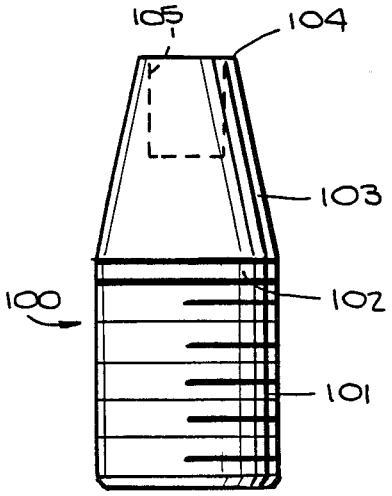
Fig. 12.
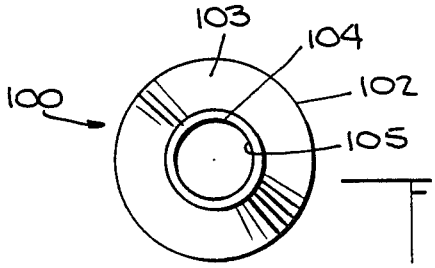
Fig. 13.
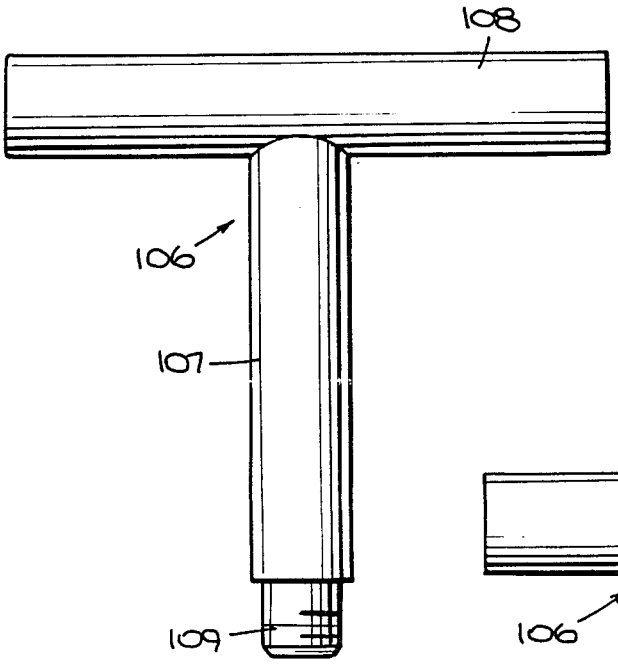
Fig. 14.
Fig. 15.
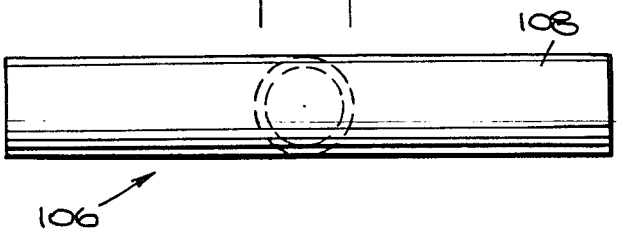

PORTABLE MANWAY COVER HANDLING APPARATUS

BACKGROUND OF THE INVENTION

This invention relates to apparatus for handling the installation and removal of manway covers on the underside of a vessel enclosure where said covers are too heavy to be handled by an unaided individual. In particular, this invention relates to apparatus and a method whereby cumbersome manway covers angularly disposed on the bottom of a vertical tube steam generator vessel can be removed and installed with a minimum of manual intervention. While the invention was made and therefore will be described in connection with the installation and removal of covers employed in steam generators used in nuclear generator stations, it would be of use in other situations where environmental conditions and handling factors make it undesirable or impossible for operating personnel to effect unaided direct manual installation and removal of such covers.

In a typical nuclear powered steam generating installation, a cluster of vertical tube steam generating vessels are disposed around and in the vicinity of a central core structure housing the reactor. The steam generating units of the type in question have on their underside a plurality of very heavy manway covers. Such manway covers are usually angularly disposed at the bottom of the steam generator and can weigh as much as 600 pounds.

Routine servicing requirements as well as other operating conditions necessitate periodic removal of these manway covers from the underside of the generator vessel. In view of the underside location and weight of the manway covers it is not a simple task to remove the cover or to install the same. Removal is currently accomplished with the use of hand operated chain falls, ratchet hoists and brute force. During the removal process, it is necessary to lower the covers a distance of as much as 30 feet to a level surface, given the typical positioning of steam generators within the total plant configuration. Installation of these manway covers also poses difficulty in that once the covers are raised to the underside of the vessel they must be positioned at an angle to the vertical prior to being secured to the manway flange. Present procedure takes a crew of about eight men between two and three hours to remove eight manway covers positioned on the undersides of the four generators in a typical steam generator installation. Reinstallation of such covers requires a considerably longer period of time since the covers must be aligned with bolt holes in the manway flanges. This operation requires the eight man crew to remain in high radiation exposure areas for prolonged periods of time.

U.S. Pat. No. 4,313,709 discloses a device for removing and/or re-installing manway covers on an apparatus under pressure. The patented device is mounted on tracks or rails about which it can traverse in order to assume a position opposite a particular manway cover that is to be removed or installed. In the patented device a hand pump is used for operating a hydraulic actuator to adjust the position of a carriage riding on a vertical shaft. A separate chain hoist is provided for use in lowering a manway cover to a lower level. The patented device is essentially permanently installed and confined to movement along the tracks from location to location. It does not contemplate remote operation.

U.S. Pat. No. 4,360,310 takes a somewhat different approach in order to provide apparatus for manipulating a manway cover. The last mentioned patent requires separate rails to be provided for each manway flange and has a carriage that rides from a horizontal position below the manway flange up on the rail and into juxtaposition with the manway flange. A winch operates a chain or rope for pulling the carriage up and along the rail. Thus, the last mentioned patented device requires rails to be permanently attached to the pressure vessel or the like at each manway opening in order to guide the appropriate carriage between floor and vessel.

Both patented devices are considerably limited in utility both from the standpoint of lack of portability and from the standpoint that an operator is required to work in close proximity to the manway cover being handled. In a nuclear reactor plant, even in the area of the steam generator unit, there is considerable radiation exposure and workers can work in the vicinity for only limited periods of time.

Therefore, it is an object of the present invention to provide apparatus for handling the manway covers in such manner that operators need be in close proximity to the manway cover for only short periods of time and can perform the major portion of the installation or removal of the manway cover from a remote and sheltered position.

It is another object of the present invention to provide a portable handling device which can be installed on sub-frame structures that normally support the steam generator vessel in close proximity to any of the manway covers that are to be handled.

SUMMARY OF THE INVENTION

In accordance with the invention there is provided portable remotely controllable apparatus for handling the installation and removal from a manway flange of a manway cover on the underside of a vessel enclosure where said covers are too heavy to be handled by an unaided individual. The apparatus comprises in combination a base member, means for releasably securing the base member to a structural beam in line with a manway flange, a boom guide sleeve, and means for attaching the guide sleeve pivotally to the base member for rotation in a plane that is normal to said structural beam about an axis that is normal to that plane of rotation. There is also a remotely controllable actuator pivotally joined to the base member and constructed to bear against the guide sleeve for imparting controlled rotation to the sleeve about the referred to axis. The guide sleeve has opposite ends and the axis of rotation is located relative to the guide sleeve such that rotation of the guide sleeve alters the elevation of a first one of the guide sleeve ends relative to the base member. An elongated hollow boom is mounted within the guide sleeve for longitudinal movement relative to the sleeve with a first boom end projecting from the referred to first one of the guide sleeve ends and a second boom end projecting from the end of the guide sleeve that is opposite the first sleeve end. Another remotely controllable actuator interconnects one of the projecting ends of the boom with the guide sleeve for moving the boom longitudinally relative to the guide sleeve. A winch mechanism is carried by the boom adjacent the second boom end, and a winch cable is trained from the winch through the boom to the first boom end and around a pulley carried thereat by the boom and therefrom to a cable connector means. The manway cover has an eye bolt secured in the manway cover peripheral edge and means are provided for detachably and articulatorily connecting the cable connector means to the eye of the eye bolt. In addition, a swing arm is pivotally attached to the boom adjacent the first boom end, the arm having an end to which is pivotally secured a pad having an operative face for engaging the surface of the manway cover. A further remotely controllable actuator interconnects the swing arm with the boom at a location near the location of attachment to the boom of the swing arm for rotating the swing arm relative to the boom. Thus, a manway cover can be engaged by the pad to support its weight with the cover in juxtaposition to a manway flange during the installation or removal of the fasteners for the cover, and the cover can be moved between a manway flange engaging position and a vertical position suspended from the cable during both installation and removal. The cover can be lowered from or raised to the site of the manway flange by the winch cable.

BRIEF DESCRIPTION OF THE DRAWINGS

The invention will be better understood after reading the following detailed description of the presently preferred embodiment thereof with reference to the accompanying drawings in which:

FIG. 1 is a fragmentary perspective view with portions broken away of a mounted manway cover near the bottom of a vertical tube steam generator vessel or the like;

FIG. 6 is a transverse sectional view taken along line 6—6 in FIG. 2;

FIG. 12 is a vertical elevation of the aligning pin;

FIG. 13 is a top plan view of the pin of FIG. 12;

FIG. 14 is a vertical elevation of the T-wrench used to extract the aligning pin of FIGS. 12 and 13 from a manway flange;

FIG. 15 is a top plan view of the T-Wrench of FIG. 14; and

FIG. 16 is a fragmentary view of the manway flange with aligning pins installed in preparation for installing a manway cover.

DETAILED DESCRIPTION OF THE PRESENTLY PREFERRED EMBODIMENT

Figure 1B:
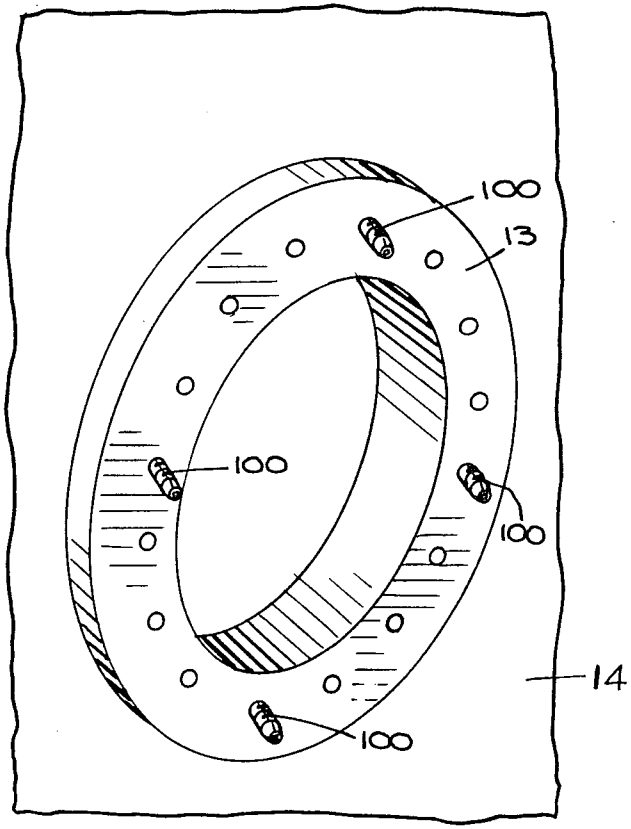
Figure 1:
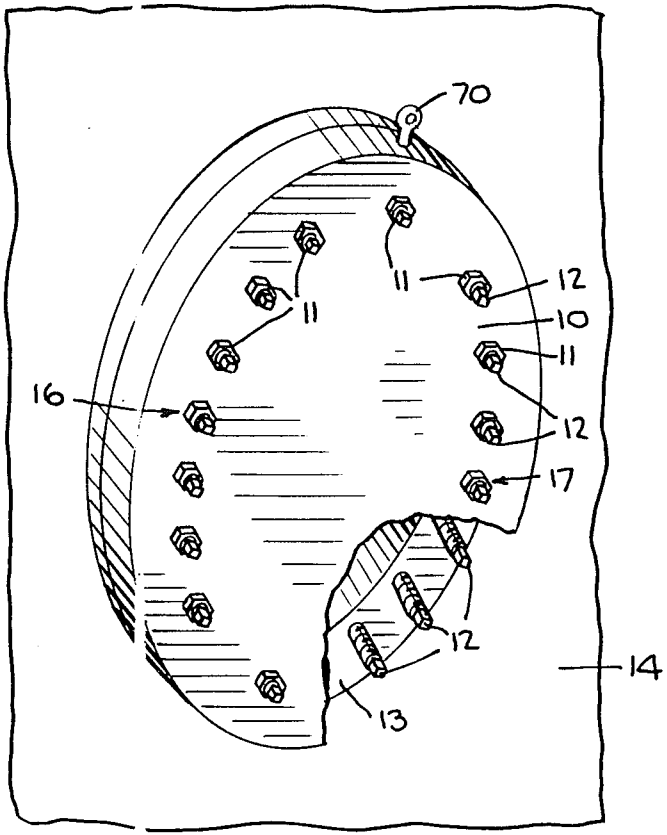

Referring now to the drawings there is shown generally in FIG. 1 a manway cover 10 secured by an array of sixteen nuts 11 on threaded studs 12 to a manway flange 13 in the wall 14 of a vessel such as might house a vertical tube steam generator in a nuclear power plant. The details of construction of the steam generator and the superstructure for supporting it are well known and constitute no part of the present invention so long as the structural framework provides free access from the point of view illustrated in FIG. 1, and a support beam such as that shown at 15 in FIG. 2 is provided near the manway flange 13 and its cover 10.

In preparation for removing a cover 10, a worker using any suitable wrenching device removes all of the nuts 11 and studs 12 except for two assemblies, diametrically opposite each other, preferably at 16 and 17. The studs 12 may have exposed ends provided with wrench flats in any known manner and be long enough to extend above the associated nuts 11 when the nuts are fully torqued.

Figure 2:
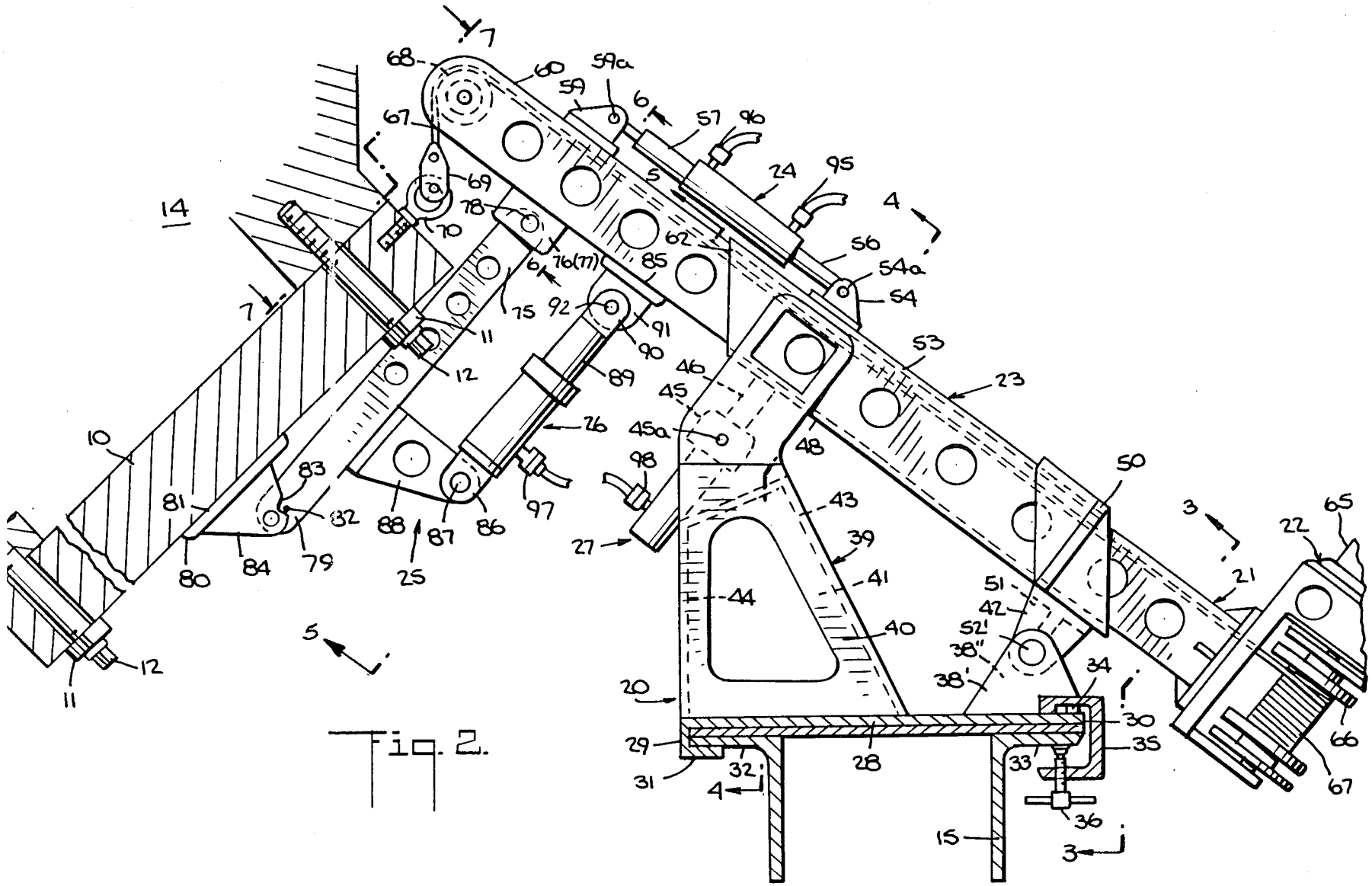
FIG. 2 is a side elevational view of an embodiment of the present invention mounted in place ready to separate a manway cover from its mounting flange.
Figure 3:
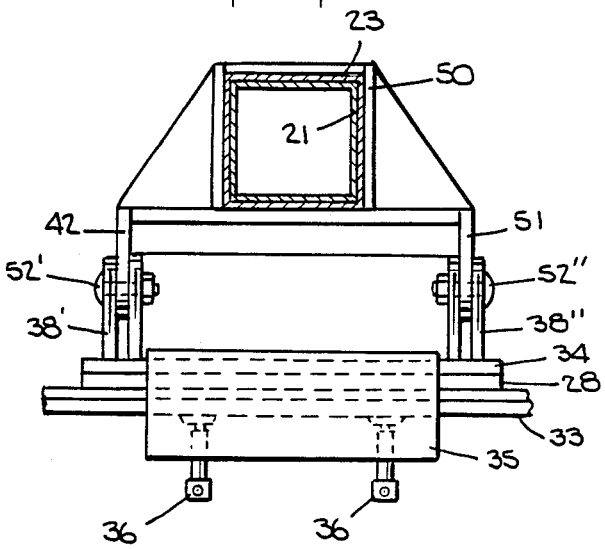
FIG. 3 is a transverse sectional view taken along line 3—3 in FIG. 2.
Figure 4:
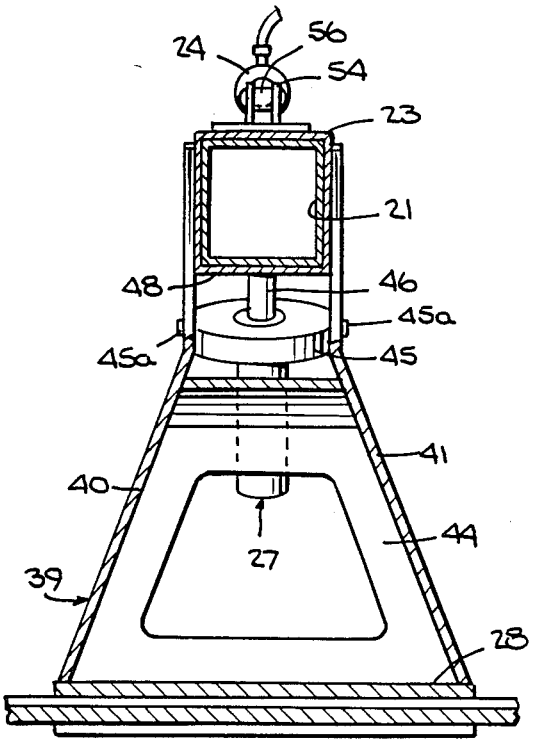
FIG. 4 is a transverse sectional view taken along line 4—4 in FIG. 2.
Figure 5:
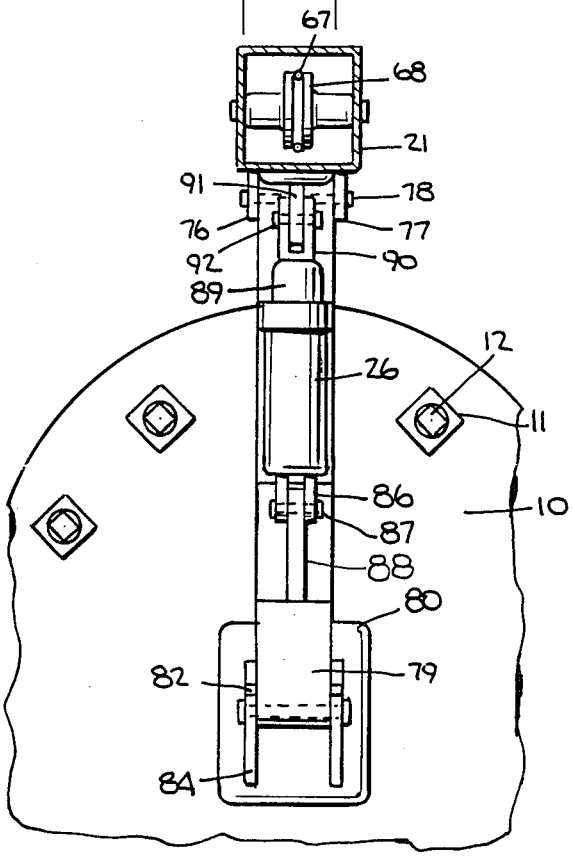
FIG. 5 is a transverse sectional view taken along line 5—5 in FIG. 2.
Figure 7:
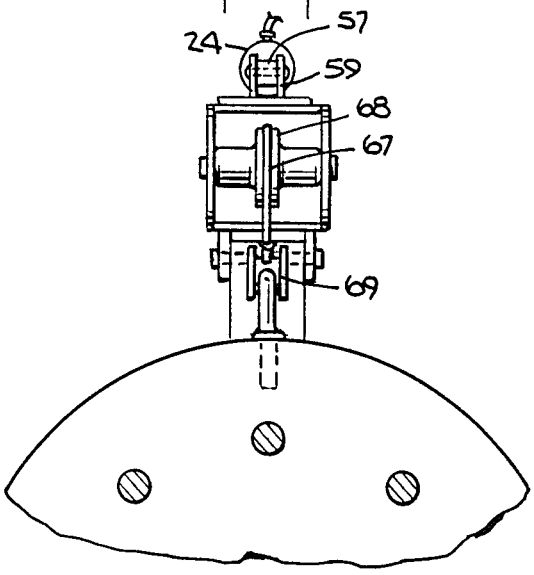
FIG. 7 is a transverse sectional view taken along line 7—7 in FIG. 2.

With the manway cover 10 held in place by the remaining nuts and studs 16 and 17, the handling apparatus is brought into position and mounted on the beam 15 as shown in FIG. 2. How this is accomplished will be explained later, after describing the apparatus.

Referring to FIGS. 2 to 7, he apparatus consists of a base 20, a boom 21, an electric powered cable winch 22, a boom guide sleeve 23, an actuator 24, a swing arm assembly 25 and its actuator 26, and a third actuator 27. The base 20 has a sole plate 28 sized to rest on beam 15 and having two parallel straight edges 29 and 30. The edge 29 is provided with a reentrant flange 31 for engaging the edge 32 of the flanged structural beam 15. When so engaged, the opposite edge 30 of the sole plate 28 is positioned in substantial juxtaposition to the second edge 33 that lies opposite the edge 32 of the beam 15. A raised lip 34 is provided on sole plate 28 adjacent the edge 30, as shown. Thus, a broad C-clamp 35 with a plurality of thumb screws 36 can engage the sole plate 28 behind the lip 34 while also engaging the underside of edge 33 of beam 15 for securing sole plate 28 to beam 15.

Mounted on sole plate 28 are two clevis structures 38' and 38" (best seen in FIG. 3) and a structural standard 39, the latter being formed from spaced apart upstanding plates 40 and 41 connected by cross or tie plates 43 and 44. Pivotally mounted upon standard 39 between plates 40 and 41 is the actuator 27, which is an hydraulic single acting ram, with its operative end mounted in a collar 45 joined by pivot pins **45*a* to plates 40 and 41. The piston 46 of actuator 27 has its exposed end positioned to engage the underside 48 of the guide sleeve 23**.

As shown, guide sleeve 23 has its end 50 reinforced and provided with ears 42 and 51 for mating engagement with clevis structures 38' and 38", respectively, to which they are pivotally joined by removable pins 52' and 52". At the other end 62 of the guide sleeve which is preferably a length of rectilinear or square cross-section tubing, there is provided on the upper surface 53 a clevis 54 which is joined by a removable pin **54*a* to the end 56 of actuator 24 which is a double acting hydraulic ram. The piston 57 of actuator 24 has its outer end pinned with a removable pin 59*a* to a clevis 59 carried at the forward end 60 of the boom 21, a rectilinear or square cross-section hollow tube congruent in cross-section to that of sleeve 23**.

The winch 22 is powered by an electric motor 65 and is arranged to drive bi-directionally a cable drum 66 from which a suitable length of cable 67 is trained through the boom 21 to the boom end 60 where it passes around a pulley 68 carried by the boom. From the pulley 68 the cable 67 extends to a suitable hook or other detachable connector means 69. An eye bolt 70 is provided in the peripheral edge of manway cover 10 located at the "12 o'clock" or uppermost position of the cover 10 when the cover is installed. See FIGS. 1 and 2.

The swing arm 25 is shown in FIG. 2 as consisting of a length of square tubing or the like with a first end 75 pivotally attached to the boom 21 adjacent the boom end 60 between spaced apart ears 76, 77, by a removable pin 78. The arm 25 has an opposite end 79 to which is pivotally secured a pad or foot 80 having an operative face 81 for engaging the surface of the manway cover 10. A stop pin 82 is located on arm 25 for cooperating with a notch 83 formed in the edge of a plate or ear 84 that is joined to foot 80. The pin 82 restricts the counter-clockwise rotation of the foot 80 relative to the arm 25 so that the foot 80 will always be in position to engage the surface of cover 10 with its face 81.

Finally, the actuator 26 is shown as an hydraulic ram which interconnects the swing arm 25 with the boom 21 at a location 85 near the location of attachment 76, 77 to boom 21 of the swing arm 25. Actuator 26 has a clevis 86 extending from the rear of the actuator cylinder which clevis is connected articulatorily by pin 87 to lateral arm 88 that extends from arm 25. A piston 89 projects from the cylinder of actuator 26 and has a clevis-formed end 90 separately pinned to an ear 91 by a removable pin 92.

Figure 8:
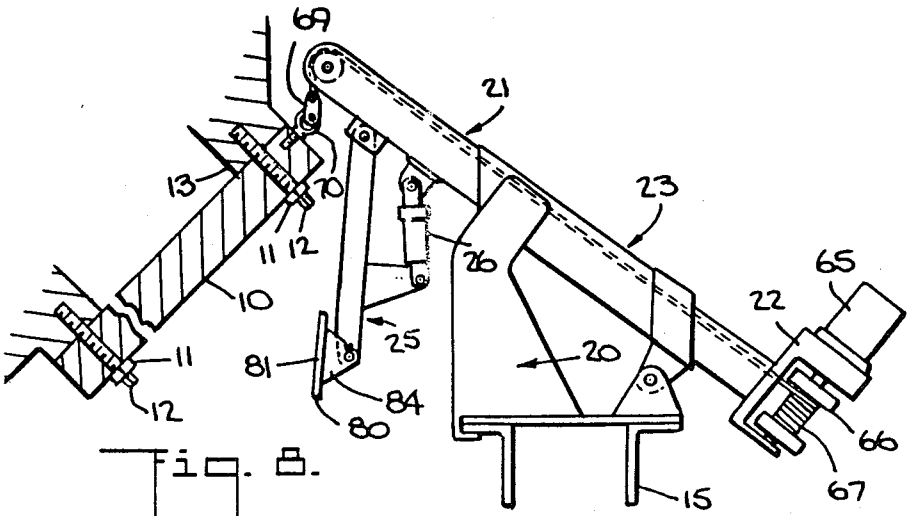
FIG. 8 is a simplified schematic illustration of the apparatus of FIG. 2 with the swing arm disengaged and the cable attached before all of the bolts have been removed from the manway cover.
Figure 9:
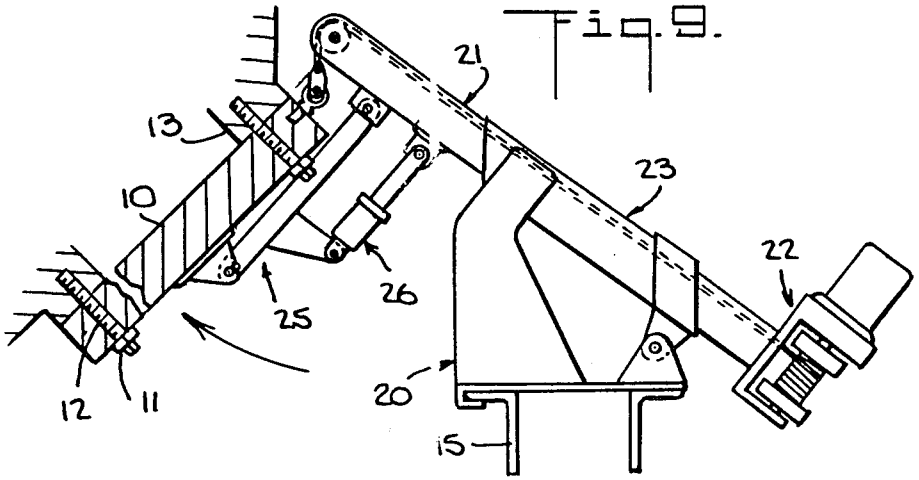
FIG. 9 is a view similar to FIG. 8 showing the adjustable pad moved into engagement with the manway cover, similar to the illustration in FIG. 2.

With the handling apparatus mounted on the beam 15, the boom 21 is extended with the swing arm 25 in the general position shown in FIG. 8 until the cable connector 69 is directly above the eye bolt 70. The connector 69 is then joined to the eye bolt 70 and the winch 22 is powered to reel in cable 67 until it is under slight tension. Hydraulic lines will have been attached by quick-connect couplings to the fittings 95, 96, 97 and 98 on the respective actuators 24, 26 and 27, and actuator 26 is now operated to move arm 25 and its foot 80 into the position shown in FIG. 2 to apply pressure to manway cover 10 sufficient to hold the cover in place while the remaining nut and stud assemblies 16 and 17 are removed.

Figure 10:
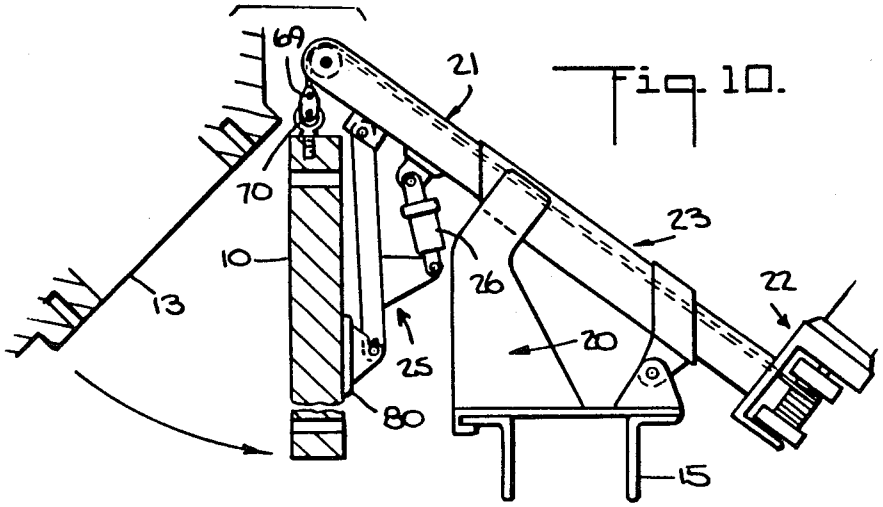
FIG. 10 is a view similar to FIG. 8 showing the adjustable pad engaging the manway cover after removal of the cover from the manway flange.
Figure 11:
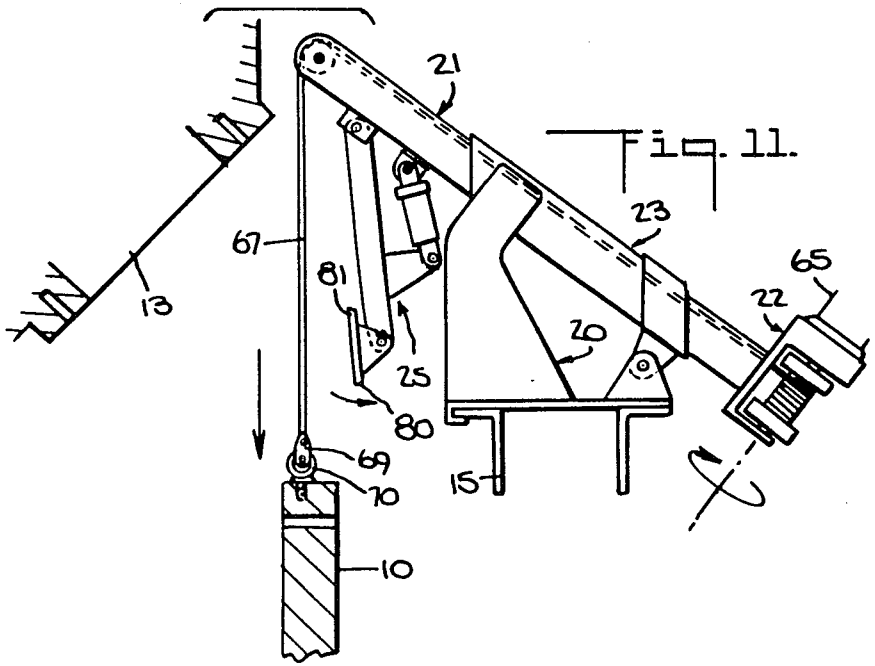
FIG. 11 is a view similar to FIG. 8 showing the manway cover being lowered by the winch cable.

Now the pressure to actuator 26 is vented and the weight of cover 10 along with the force of a return spring (not shown) will cause retraction of actuator 26 until the condition shown in FIG. 10 is reached. The spring return will cause further retraction of arm 25 to insure clearance between cover 10 and foot 80. Winch 22 is now powered to pay out cable 67 and lower cover 10 to a temporary storage or receiving area some thirty feet below as shown diagrammatically in FIG. 11.

The entire apparatus consisting of components 20 to 27 is light enough that two persons on the usual catwalk adjacent beam 15 can carry the apparatus to a second location in front of another manway cover so that the procedure can be repeated.

It should now be apparent that, except for the removal of the nuts 11 and studs 12, and engaging connector 69 with eye bolt 70, after the apparatus is positioned on the beam 15, all operation of the device can be conducted from a remote sheltered site by means of hydraulic control valves and electric switches with appropriate hydraulic and electrical lines (not shown) to the hydraulic actuators and electric winch, respectively.

Actuator 27 is employed to adjust the elevation of boom 21 about pivot pin or point 52, while actuator 24 extends and retracts boom 21, as needed. Actuator 24 is secured to guide sleeve 23 by the clevis 54 to ensure that no detrimental bending forces will be applied to piston 57 if the boom 21 should bend or deflect under load.

Installation of the manway cover 10 is accomplished essentially by reversing the above described operation. However, to minimize the problem of aligning the bolt holes in the heavy cover with the studs with which the bolt holes mate with conventional clearance, there is provided a series of preferably four aligning pins or plugs, one of which is shown in detail in FIGS. 12 and 13. The aligning pin 100 has a threaded end 101 sized and threaded to fit the threaded holes in manway flange 13. The threaded end 101 joins a cylindrical section 102 of short axial length, e.g., $\frac{1}{4}''$, which connects with a tapered end region 103.

With the threaded end 101 having a nominal thread diameter of $1\frac{7}{8}''$, the section 102 can also have a nominal diameter of $1\frac{7}{8}''$ while the tapered region 103 reduces to an end 104 having a diameter of 1". Counterbored in the narrow end 104 is a hole 105 tapped with a thread of opposite hand to the thread 101. The tapped hole 105 may be 1" deep and $\frac{3}{4}''$ in diameter. The purpose of thread 105 is to provide means whereby pin 100 can be engaged by a tool to rotate pin 100 in a direction to remove such pin from a manway flange as will be explained below. The tool for this purpose is shown in FIGS. 14 and 15 as consisting of a T-shaped member 106 having a shaft 107, a cross head 108 and a reduced diameter threaded extension 109 for mating with hole 105.

The initial step in the cover installation procedure is to insert hand-tight four aligning pins 100 at 90° intervals around the manway flange 13, preferably, as shown in FIG. 16, at the "12", "3", "6" and "9" o'clock positions. The remaining bolt or stud holes should remain free. The cable 67 is then payed out and connector 69 joined to eye bolt 70. Next, the winch 22 is powered to raise the manway cover from the position shown in FIG. 11 to the relationship shown in FIG. 10. Power is applied to actuator 26 to swing the arm 25 clockwise as viewed in the drawings, to bring the foot 80 against the cover and raise the latter into proximity with flange 13. The tapered ends of the aligning plugs 100 enter the corresponding bolt holes in the cover 10 and pilot the cover into precise alignment with the bolt holes in flange 13. When the cover 10 is pressed by the arm 25 snugly against flange 13, a mechanic can approach the manway and insert two or more assemblies of threaded studs 12 and nuts 11 into available holes and tighten the nuts sufficiently to hold the cover 10 in place. Now, the arm 25 can be withdrawn and the cable 67 separated from cover 10.

Using tool 106, the aligning pins are removed and the remaining studs 12 and nuts 11 are installed. After suitable torquing, the installation is complete.

The presently preferred procedure for placing the handling apparatus on beam 15 is to bring the assembly into the boiler area at the base of the boiler infrastructure. Assuming the provision of suitable hooks or eyes on the frame superstructure above the level of beam 15, the cable 67 from the winch 22 can be payed out with the connector end being carried in any suitable manner up to the hook or eye on the superstructure, the cable connector engaged, and the winch powered to take up the cable so as to hoist itself up to the desired level where two persons can handle the weight and locate the apparatus on beam 15.

Where suitable connector engaging means are not present, the apparatus can be separated into a series of parts by removing the removable pins 52', 52'', 54a, 59a, 78 and 92. The separate parts are small and light enough to be carried up ladders to the desired level.

The foregoing description and drawing illustrations have assumed that the relationship between the support beam 15 and the manway cover 10 is such that a common plane exists that is simultaneously a radial plane of the vertical tube steam generator and is normal to the longitudinal axis of the beam 15 and to the plane of cover 11. However, in a known generator installation such is not the case, the beam 15 being skewed relative to that radial plane of the steam generator that bisects the manway cover. In such instance the centerline through the clevis assemblies 38' and 38'' should be positioned angularly relative to base plate 28 so that the longitudinal axis of boom 21 can be positioned at an angle to the longitudinal axis of beam 15 and in that radial plane of the generator that bisects cover 11.

Having described the presently preferred embodiment of the present invention, it will be understood that various changes in construction can be introduced by one skilled in the present art without departing from the true spirit of the invention as defined in the appended claims.

What is claimed is:

1. Portable remotely controllable apparatus for handling the installation and removal from a manway flange of a manway cover on the underside of a vessel enclosure where said covers are too heavy to be handled by an unaided individual, said apparatus comprising in combination a base member, means for releasably securing said base member to a structural beam in line with a manway flange, a boom guide sleeve, means for attaching said guide sleeve pivotally to said base member for rotation in a plane that is normal to said structural beam about an axis that is normal to said plane, a remotely controllable actuator pivotally joined to said base member and constructed to bear against said guide sleeve for imparting controlled rotation to said sleeve about said axis, said guide sleeve having opposite ends and said axis being located relative to said guide sleeve such that said rotation of said guide sleeve alters the elevation of a first one of said guide sleeve ends relative to said base member, an elongated hollow boom mounted within said guide sleeve for longitudinal movement relative to said sleeve with a first boom end projecting from said first one of said guide sleeve ends and a second boom end projecting from the end of said guide sleeve that is opposite said first sleeve end, another remotely controllable actuator interconnecting one of said projecting ends of said boom with said guide sleeve for moving said boom longitudinally relative to said guide sleeve, a winch mechanism carried by said boom adjacent said second boom end, a winch cable trained from said winch through said boom to said first boom end and around a pulley carried thereat by said boom and therefrom to a cable connector means, said manway cover having an eye bolt secured in the manway cover peripheral edge, means for detachably and articulatorily connecting said cable connector means to the eye of said eye bolt, a swing arm having a first end pivotally attached to said boom adjacent said first boom end, said arm having an opposite end to which is pivotally secured a pad having an operative face for engaging the surface of said manway cover, and a further remotely controllable actuator interconnecting said swing arm with said boom at a location near the location of attachment to said boom of said swing arm for rotating said swing arm relative to said boom, whereby a manway cover can be engaged by said pad to support its weight with said cover in juxtaposition to a manway flange during the installation or removal of fasteners for said cover, said cover can be moved between a manway flange engaging position and a vertical position suspended from said cable during both installation and removal, and said cover can be lowered from and raised to the site of said manway flange by said winch cable.

2. Portable apparatus according to claim 1, wherein a plurality of aligning pins each has an externally threaded end for threaded assembly in a threaded stud hole in the manway flange and a tapered smooth end for projecting from said manway flange to guide bolt holes in the manway cover into aligned juxtaposition.

3. Portable apparatus according to claim 2, wherein each of said aligning pins has, entering from its tapered end, a bore threaded with opposite hand to that of its externally threaded end, and wherein there is provided a wrench with a threaded shaft-end threaded for mating assembly with said opposite hand threaded bore in said pin for removing said pins from said manway flange.

4. Portable apparatus according to claim 2, wherein said actuators are hydraulic rams.

5. Portable apparatus according to claim 4, wherein said winch is powered by an electric motor.

6. Portable apparatus according to claim 1, wherein said actuators are hydraulic rams.

7. Portable apparatus according to claim 6, wherein said winch is powered by an electric motor.

8. Portable apparatus according to claim 1, wherein said means for securing said base member to a structural beam comprises a sole plate with at least two parallel straight edges, one edge being provided with flanged means for engaging a first edge of a flanged structural beam while positioning the other of said edges in substantial juxtaposition to a second edge of said flanged structural beam opposite said first edge, a raised lip on said sole plate adjacent said other edge of said sole plate, and at least one releasable clamp member for engaging said sole plate behind said lip and engaging an underside of said second edge of said flanged structural beam for securing said sole plate to said structural beam.

9. Portable apparatus according to claim 8, wherein said means for attaching said guide sleeve pivotally to said base member comprises a clevis arrangement mounted on said base member, apertured plate means secured to said guide sleeve perpendicular thereto, and pin means for securing said apertured plate means to said clevis arrangement.

* * * * *